United States Patent [19]

Damico

[11] 3,982,291

[45] Sept. 28, 1976

[54] BED FRAME LOCKING ASSEMBLY AND METHOD

[75] Inventor: Frank M. Damico, Hull, Mich.

[73] Assignee: Joerns Furniture Company, Stevens Point, Wis.

[22] Filed: June 23, 1975

[21] Appl. No.: 589,375

[52] U.S. Cl. ..... 5/294; 5/288

[51] Int. Cl.[2] ..... A47C 27/08

[58] Field of Search ..... 5/200 C, 201, 282 R, 5/288, 294, 296, 295, 302, 303; 182/178; 403/187, 353; 29/469

[56] References Cited

UNITED STATES PATENTS

| | | | |
|---|---|---|---|
| 6,451 | 5/1849 | Brooke | 5/302 |
| 608,000 | 7/1898 | Leatherman et al. | 403/353 |
| 1,520,520 | 12/1924 | Thomason | 5/299 |
| 2,845,636 | 8/1958 | Iaquinta et al. | 5/296 X |
| 3,637,086 | 1/1972 | Klein | 5/296 |

FOREIGN PATENTS OR APPLICATIONS

| | | | |
|---|---|---|---|
| 9,363 | 9/1900 | Norway | 5/296 |

*Primary Examiner*—Paul R. Gilliam
*Assistant Examiner*—Andrew M. Calvert
*Attorney, Agent, or Firm*—Price, Heneveld, Huizenga & Cooper

[57] ABSTRACT

The specification discloses a locking apparatus and method for assembling bed frames which simplifies assembly of such frames allowing the same to be easily and quickly accomplished by one person. Included in the apparatus are opposing rigid bracket members joined by a rigid, two-point connection. One connection provides a pivot while a camming means cams the other connection into a corresponding receiving means to lock the members together when one member is rotated about the pivot. The method includes pivotally supporting one member on the other and rotating one member with respect to the other while camming a locking projection into a receptacle to lock together the members and their associated mattress and head or foot support frames.

23 Claims, 6 Drawing Figures

BED FRAME LOCKING ASSEMBLY AND METHOD

BACKGROUND OF THE INVENTION

Apparatus for assembling and locking together various portions of bed frames have typically utilized either two or three-point connections at each corner of a bed for joining a mattress support, frame, or spring assembly to head or foot support frames. In the typical three-point connection, a pair of rigid connectors extend between brackets on the various portions of the bed while the mattress side rail or like portion is wedged in place against either the head or foot frame or a portion of the opposing bracket. Alternatively, three rigid connectors extend into tapered slots such that when weight is placed on the mattress support, the connectors are tightly wedged into the slots. Although being quite rigid and secure, such three-point connections have typically been very difficult to assemble and disassemble, requiring either two persons or a great deal of time if only one person is making the assembly.

Prior known two-point connections between bed frame portions, while being easier to assemble, have been somewhat loose, sloppy, and generally less secure than the three-point connections. In such apparatus, a pair of rigid connectors spaced apart along opposing brackets on the various bed frame portions are provided to join the frame sections together either with or without wedging of the mattress or side rail against any other portion. Such two-point connectors are generally less durable, have a shorter life span than do more rigid connectors, and fail to provide any simplification of conventional assembly procedures.

With either prior known connectors, the typical assembly technique is to hold the head or foot frame generally upright while at each end of each side rail is successively lifted and joined to the head or foot frame. Often, especially with heavier, more durable beds such as hospital beds which may be either manual or electric, head or foot frames are bulky and heavy and difficult for a single person to maintain upright while the mattress support is assembled thereto. Accordingly, the presence of two persons is often required necessitating inconvenience and greater expense for assembly.

The present invention overcomes these problems and provides a strong, secure, tight connection apparatus for portions of bed frames as well as a method for assembly of such apparatus which allows a single person to easily and quickly assemble even heavy, large, and bulky bed frames.

SUMMARY OF THE INVENTION

The present invention provides a bed frame locking apparatus and assembly method especially adapted to secure a head or foot support frame to a mattress support. The invention utilizes a two-point connection from a pair of opposing, rigid bracket members, one of such pairs of brackets preferably being positioned at each corner of a bed frame. Included are pivot means for supporting one of the bracket members for pivotal movement with respect to the other, as well as a rigid connection means on at least one of the brackets for engaging the other bracket member which has receiving means for receiving the rigid connector. The essence of the invention lies in pivoting one bracket member with respect to the other such that camming means on the member opposite the member including connecting means cams the connecting means into the receiving means. The invention rigidly secures the various portions of the bed together while utilizing only a single rotating motion which can easily be accomplished by a single person.

In one aspect, the invention is a bed frame locking assembly including first and second rigid, opposing brackets. Pivot means are included on at least one of the brackets as well as the rigid connection means and receiving means therefor. Camming means are provided for camming the connection means into the receiving means when the brackets are pivoted with respect to each other about the pivot means whereby the brackets are locked together to rigidly secure a support frame to a mattress support.

In another aspect, the invention is a method for assembling a bed frame or the like, the bed frame being of the type including a mattress support and a support frame adapted to support a head or foot portion of the mattress support. The method includes pivotally supporting one of the brackets on the other while the support frame is generally folded with respect to the mattress support. The support frame, including the second bracket, is pivoted to an upright position with respect to the mattress support while camming the locking projection on one of the brackets into a receiving means on the other whereby the support frame is rigidly connected to the mattress support.

In the preferred embodiment, the pivot means is a cylindrical projection on one bracket engaging an elongated slot on the other while the connection means is a cylindrical projection extending opposite to the pivot projection and adapted to be cammed by an inclined edge on the opposing member into a receiving slot on the member including the inclined edge.

These and other objects, advantages, purposes, and features of the invention will become more apparent from a study of the following description taken in conjunction with the drawings.

DESCRIPTION OF THE PREFERRED EMBODIMENT

Figure 1:
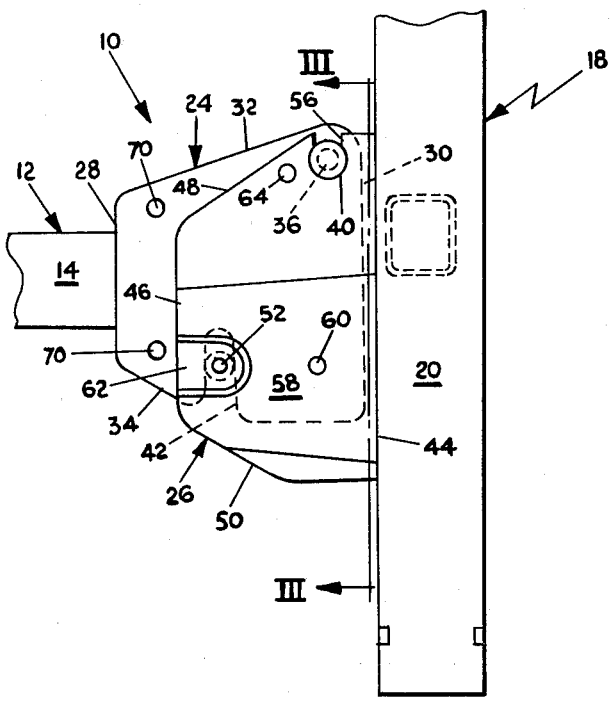
FIG. 1 is a fragmentary, side elevation of the bed frame locking assembly of the present invention rigidly attaching a mattress support to a head or foot support frame of a bed.
Figure 3:
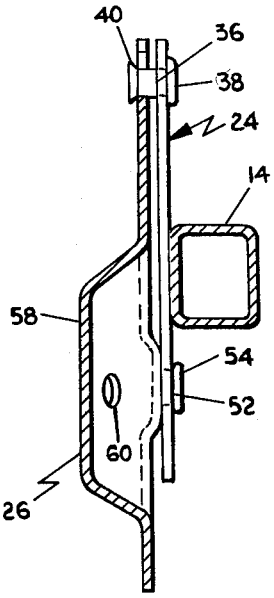
FIG. 3 is a sectional end elevation of the locking assembly taken along plane III—III of FIG. 1.
Figure 2:
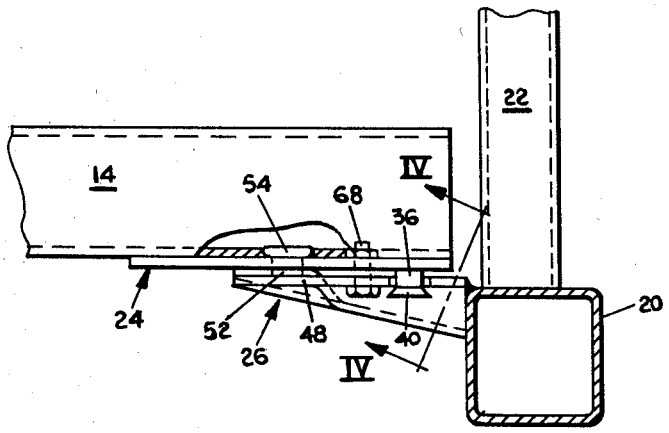
FIG. 2 is a fragmentary, plan view of the locking assembly shown in FIG. 1 with portions of the bed frame broken away to illustrate portions of the assembly.
Figure 5:
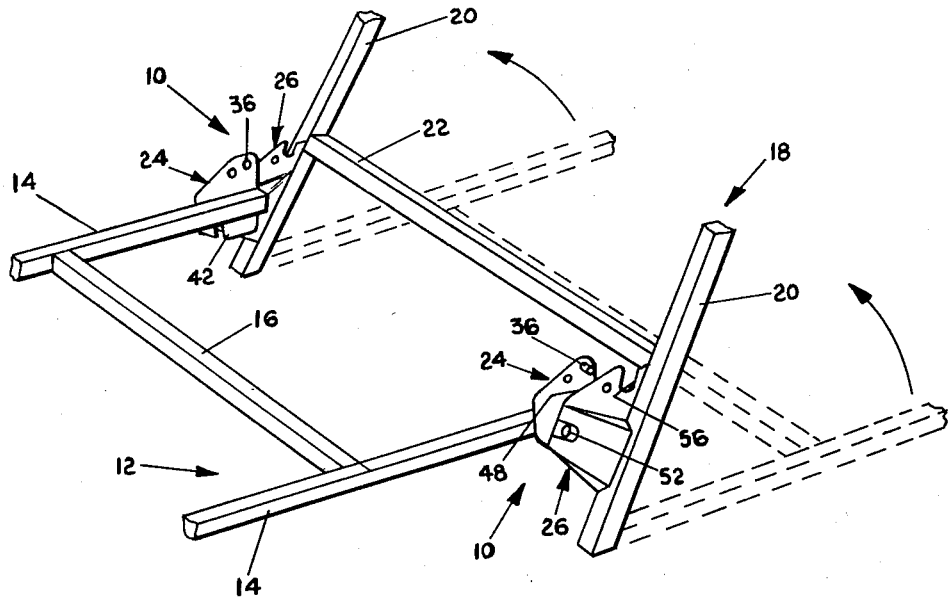
FIG. 5 is a fragmentary, perspective view of a pair of the present locking assemblies secured to a bed frame and illustrating the rotational movement of the head or foot support frame with respect to the mattress support for assembly of the bed frame.

Referring now to the drawings in greater detail, FIGS. 1–3 illustrate the bed frame locking assembly 10 secured and rigidly attached between a mattress support or spring frame 12, including a pair of side rails 14 and one or more cross braces 16 (FIG. 5), and a support frame 18 which supports the mattress support 12 at either the head or foot end of the bed. Head or foot support frames 18 generally each include a pair of upright support legs 20 rigidly secured in spaced relationship to one another by one or more generally horizontal cross braces 22 (FIG. 5). The invention allows the assembly of frame 18 to the mattress support 12 by simply pivotally supporting one entire end of the mattress support on the brackets which are rigidly secured to the head or foot support frame while the same lies on the support surface. Thereafter, frame 18 is pivoted to an upright position while the locking assembly 10 automatically cams itself into the proper locking position.

Each of the bed frame locking assemblies 10 of which four are preferably used in a bed frame, one at each corner, includes a pair of rigid, opposing bracket members or plates 24, 26. Bracket 24 is rigidly secured by welding or the like to the outside surface of one end of one side rail 14 of mattress support 12. Bracket 26 is rigidly secured by welding or the like such that it extends perpendicularly outwardly from one side surface of one upright leg 20 at a corner thereof on frame 18. Bracket 24 is a generally planar plate having a short end edge 28 and a longer end edge 30 between which extend inclined top and bottom edges 32, 34, respectively. Edges 32, 34 generally diverge such that the longer end edge 30 is positioned at the end of the mattress support.

At the upper corner adjacent the long end edge 30 of bracket 24 is a rigid, cylindrical, pin connector 36 which extends through a corresponding aperture in the bracket plate generally perpendicularly to the plate and is secured thereto by a head 38 in a rivet-like fashion (FIG. 3). Pin connector 36 includes a conical head 40 which diverges outwardly away from the cylindrical section of the pin to form an enlarged head which prevents horizontal separation of the brackets when secured together. At the bottom edge 34 of bracket 24 is formed an elongated slot 42 extending generally vertically upwardly into the body of the planar plate of the bracket. Slot 42 is spaced horizontally and vertically from the location of rigid pin connector 36 when the brackets 24, 26 are assembled and is adjacent the lower corner near the short end edge 28 of the bracket. Slot 42 is adapted to fit over a pivot pin on the opposite bracket to provide pivotal movement of the brackets with respect to one another.

As is best seen in FIGS. 1–4, the opposing bracket member 26 is stamped from suitable metallic plate material or the like and includes a longer end edge 44 and a shorter end edge 46. Edge 44 is adapted to be secured by welding or the like to the outer surface of leg 20 such that the entire bracket 26 extends generally parallel to the bracket 24 when assembled. Top and bottom edges 48 and 50 of bracket 26 generally converge and taper toward the shorter end edge 46. Near the shorter end edge 46, and spaced slightly upwardly from the bottom edge 50, is a rigid, cylindrical, pivot pin 52 including a rounded, enlarged head 54 on its free end. Head 54 prevents horizontal separation of the brackets 24, 26 as does the conical head 40 on cylinder 36. Pin 52 is rigidly secured in a suitable aperture through bracket 26 such that it extends inwardly toward bracket 24 and is generally perpendicular thereto. Pivot pin 52 is adapted to be received in slot 42 of bracket 24.

At the upper edge 48 of bracket 26 near the longer end edge 44 of that bracket is a receiving slot 56 extending generally vertically downwardly into the body of the bracket. Immediately adjacent slot 56, top edge 48 of bracket 26 is inclined downwardly toward the shorter end edge 46 to provide an inclined camming edge surface along top edge 48. As the head or foot support frame is pivoted to its upright position, camming edge 48 forces connector pin 36 to slide upwardly therealong until it drops into slot 56 to rigidly secure the brackets together. During the camming action, the elongated slot 42 provides a guide for vertical movement of pivot pin 52 which defines the pivot axis for the rotation.

Figure 4:
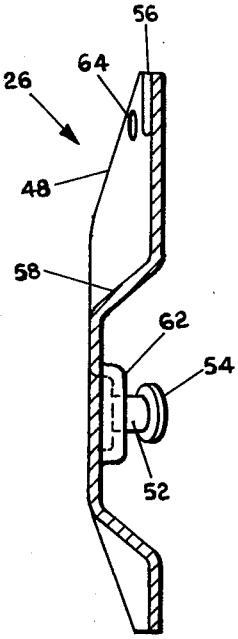
FIG. 4 is a sectional, end elevation of the bracket member adapted to be secured to a head or foot support frame and taken along plane IV—IV of FIG. 2.
Figure 6:
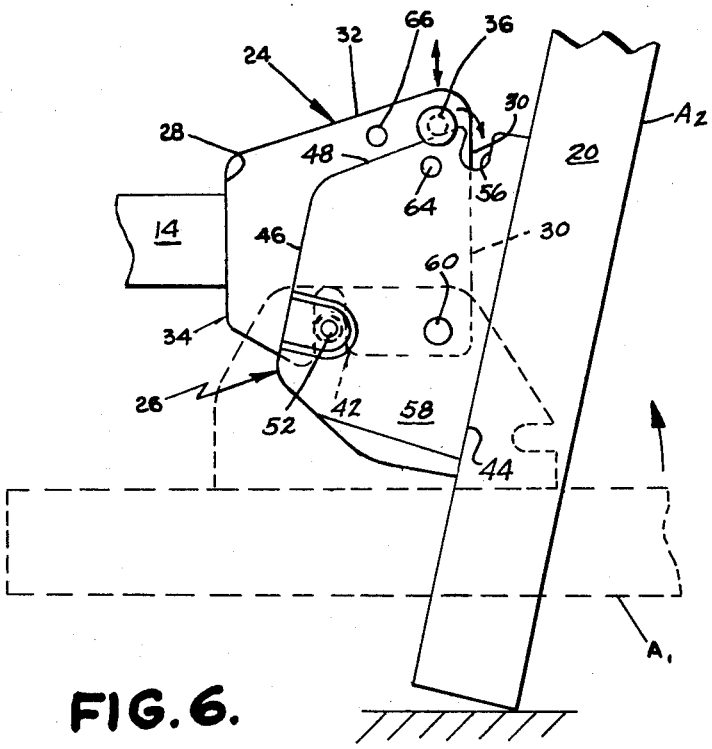
FIG. 6 is a fragmentary, side elevation of the assembly method of the present invention.

As is best seen in FIGS. 3 and 4, the central section 58 of bracket 26 is offset outwardly by a stamping process or the like during manufacture. The distance of the offset is greatest at edge 44 which is secured to the support leg of a head or foot frame. The offset tapers to the plane of the remainder of the bracket at the shorter end edge 46. Offset area 58 provides a protected, concealed area allowing attachment of a pulley or other lifting apparatus therein by means of an aperture 60 therethrough (FIGS. 1, 2, and 6). Thus, the locking assembly 10 may be used with a HiLo type bed such as is employed in hospitals and utilizes a pulley and cable system to raise and lower a telescoping leg within leg 20 in the conventionally known manner. In addition, offset area 58 at end edge 44 provides horizontally spaced points for attachment of bracket 26 to leg 20. Such spaced points stabilize the bracket on the leg 20.

Near short edge 46 of bracket 26 in the central offset section 58 is another offset section 62 which is offset in the reverse direction from offset 58, i.e., toward bracket 24. Section 62 provides a securing platform in which pivot pin 52 is generally centered while the planar portions of the platform 62 surrounding pin 52 provide a steadying and stabilizing area which directly engages the planar outside surface of the opposing bracket 24. These surfaces which surround pin 52 on offset section 62 are generally parallel to the exterior surface of bracket 24 such that a secure, stable interengagement is provided (see FIG. 2). Head 54 of pin 52 is spaced from the exterior surface of offset area 62 a distance approximately equal to the thickness of planar bracket 24 such that when pin 52 is received in slot 42, head 54 retains the bracket 24 tightly against offset area 62. Conical head 40 on connector pin 36 is spaced a like distance from the exterior surface of bracket 24 and also serves to retain the brackets together and prevent horizontal movement between the brackets. The conical taper constantly biases the brackets together during the camming motion along upper edge 48 when the brackets are assembled.

If a more permanent connection between brackets 24, 26 is desired, a bolt 68 may be secured through a pair of axially aligned apertures 64, 66 provided in the brackets near their upper edges. Bolt 68 not only helps prevent horizontal movement of the brackets apart from one another but also prevents vertical movement of connector pin 36 out of slot 56 when the brackets are locked together. Also, additional apertures 70 are provided through bracket 24 for attachment of an electric motor or the like when the brackets are used with power-operated hospital beds or other similar apparatuses.

METHOD OF ASSEMBLY

Referring now to FIGS. 5 and 6, the bed frame locking assembly described above with reference to FIGS.

1–4 is easily and simply assembled by a single operator even when mattress support 12 and head and foot support frame 18 are extremely heavy and bulky. Head or foot frame 18 is laid on a suitable support surface with brackets 26 extending generally vertically upwardly as shown in phantom in FIGS. 5 and 6. Thereafter, the operator steps between the side rails 14 of frame 12 and lifts one end of that frame over the prone head or foot support frame such that pivot pins 52 are received in slots 42. In this position, the pivot pins 52 rest on the rounded end surfaces of slots 42.

Thereafter, the operator steps between the upper ends of legs 20 of head or foot support frame 18 and rotates the head or foot frame about the bottom ends of the legs (FIG. 6). Brackets 26 and pivot pins 52 rotate and pivot with respect to slots 42 as shown in solid in FIG. 6. As frame 18 is pivoted to its upright position, rigid connector pins 36 engage inclined camming edges 48 along the tops of brackets 26 (position $A_2$ in FIG. 6). Continued rotation about the bottom ends of legs 20 causes pins 36 to slide along camming edges 48 until they drop into slots 56 when frame 18 is vertically upright (FIG. 1). During the camming action described above, the upward incline of the camming edges force pins 36, and thus the entire brackets 24 and the ends of mattress support 12, upwardly. This upward movement is guided by the parallel sides of slots 42 which have a sufficient length to allow pivot pins 52 to be guided thereby during the entire camming action. Once pin 36 comes to rest at the bottom of slot 56, pivot pin 52 is approximately at the middle of slot 42 as is best seen in FIG. 1.

Thereafter, a securing bolt 68 may be passed through apertures 64, 66 to further secure the locking assembly together although the bolt is not required. Then, the other end of the mattress frame 12 may be assembled to its appropriate head or foot support frame 18 in the same manner.

Disassembly of the apparatus is accomplished by removing any bolt 68 from apertures 64, 66 and lifting the appropriate end of mattress support 12 until connector pin 36 is out of engagement with slot 56. Thereafter the head or foot support frame 18 may be pivoted downwardly to its prone position on the support surface after which the mattress support may be lifted off pivot pins 52.

Accordingly, it will be understood that the present apparatus provides a simple, effective, and highly reliable method for securing various portions of a bed frame together. Although the assembly is typically used at the corners of the bed frame, it may be also positioned at other areas of the bed frame. Further, the positions of the corresponding pivot pins and pivot slots, as well as the connector pins and receiving slots may be reversed between the brackets. Also, it is possible to provide both of the slots on one of the brackets while the pivot and connecting pins are each on the opposing bracket. In that situation, the slots may have slightly different configurations although one pin will always provide a pivotal support for the opposing bracket. A portion of the other bracket will always provide a camming action for the other pin along an edge of a slot or other portion of that other bracket until the connecting pin is located in an appropriate receiving slot on the opposing bracket for rigid securement of the brackets together. In each case, the slot receiving the pivot pin will have sufficient length to guide the pivot pin therealong during the camming action of the connector pin along the appropriate camming surface of the opposite bracket. The slot will also retain the pivot pin when the connecting pin enters its appropriate receiving slot. Accordingly, a rigid durable connection between the opposing brackets is maintained even though only two, spaced connectors are used.

While several forms of the invention have been shown and described, other forms will now be apparent to those skilled in the art. Therefore, it will be understood that the embodiments shown in the drawings and described above are merely for illustrative purposes, and are not intended to limit the scope of the invention which is defined by the claims which follow.

The embodiments of the invention in which an exclusive property or privilege is claimed are defined as follows:

1. A bed frame locking assembly for attaching a support frame to a mattress support comprising:

first and second rigid, opposing brackets;

pivot means on at least one of said brackets for supporting the other of said brackets for pivotal movement with respect to the one bracket;

rigid connection means on at least one of said brackets for engaging the other of said brackets and receiving means on the other of said brackets for receiving said connection means; the engagement of said connection and receiving means preventing pivotal movement of said brackets with respect to each other when said pivot means is supporting said other bracket; and camming means for camming said connection means into said receiving means when said brackets are pivoted with respect to each other about said pivot means whereby said brackets are locked together to rigidly secure a support frame to a mattress support.

2. The assembly of claim 1 wherein said camming means include an inclined surface adjacent said receiving means on one of said brackets, said connection means adapted to slide along said surface and into said receiving means as said support frame is pivoted from a generally folded position to a generally upright position with respect to said mattress support.

3. The assembly of claim 2 wherein said connection means is a projection of one of said brackets; said receiving means including a slot on the other of said brackets.

4. The assembly of claim 3 wherein said one bracket is mounted on said mattress support, said projection extending perpendicularly outwardly from said one bracket toward said other bracket which is mounted on said support frame.

5. The assembly of claim 4 wherein said pivot means includes a pivot projection on said other bracket extending perpendicularly outwardly therefrom toward said one bracket and a receiving slot in said one bracket for receiving said pivot projection on said other bracket.

6. The assembly of claim 5 wherein said receiving slot in said one bracket is elongated in a direction generally toward the position of said projection on said one bracket such that said pivot projection on said other bracket moves along and is guided by the walls of said receiving slot at all times during camming of said projection on said one bracket into said slot in said other bracket.

7. The assembly of claim 5 wherein said receiving slot and projection are spaced apart on said one bracket both horizontally and vertically, said slot and pivot projection on said other bracket being spaced apart correspondingly on said other bracket.

8. The assembly of claim 1 wherein said camming means, connection means, and receiving means are positioned along and adjacent the top edges of said brackets, said pivot means being located adjacent the bottom edges of said brackets.

9. The assembly of claim 1 wherein said connection means is a projection on one of said brackets; said receiving means including a slot on the other of said brackets.

10. The assembly of claim 9 wherein said pivot means includes a pivot projection on one of said brackets extending toward the other bracket and a slot in said other bracket for receiving said pivot projection on said one bracket.

11. The assembly of claim 10 including a head on each of said projections, said heads being larger than the widths of said respective slots in which said projections are received.

12. The assembly of claim 1 wherein said pivot means includes a pivot projection on one of said brackets extending toward the other bracket and a slot in said other bracket for receiving said pivot projection on said one bracket.

13. The assembly of claim 12 wherein said slot is elongated in a direction extending generally toward said connection and receiving means such that said pivot projection moves along and is guided by the walls of said slot at all times during camming of said connection means into said receiving means.

14. The assembly of claim 1 wherein at least one of said brackets includes an offset portion for receiving a pulley or other lifting means for lifting said assembly with respect to a support surface and additional securing means for securing said assembly in its locked condition.

15. The assembly of claim 1 in combination with a head or foot support frame for a bed and a mattress support for a bed, said first bracket being rigidly secured to said head or foot support frame while said second bracket is rigidly secured to said mattress support.

16. A bed frame locking assembly for attaching a head or foot frame to a mattress support comprising:

a rigid bracket having a height, width, and top, bottom, and side edges and adapted to be secured to a head or foot support frame of a bed;

a rigid locking member having a height, width, and top, bottom, and side edges and adapted to be secured to a mattress support of a bed;

said locking member including a first locking projection adjacent its top edge which extends toward said bracket and a first slot extending inwardly of said locking member from its bottom edge;

said bracket including a second locking projection extending toward said locking member and adapted to be received in said first slot and a second slot extending inwardly of said bracket from its top edge for receiving said first projection, said second locking projection including pivot means for allowing pivotal movement of said locking member with respect to said bracket except upon receipt of said first locking projection in said second slot; and camming means for camming said first locking projection into said second slot as said bracket and locking member are pivoted with respect to one another whereby a head or foot support frame and mattress support may be securely and rigidly locked together by said assembly.

17. The assembly of claim 16 wherein said camming means includes an inclined surface adjacent said second slot on said bracket; said first projection adapted to slide along said inclined surface and into said second slot as said head or foot frame is pivoted from a generally folded position to a generally upright position with respect to said mattress support.

18. The assembly of claim 16 including a head on each of said projections, said heads being larger than the widths of said respective slots in which said projections are received.

19. The assembly of claim 16 wherein said first slot is elongated in a direction generally toward said first projection such that said second projection is guided by the walls of said first slot at all times during camming of said first projection into said second slot.

20. The assembly of claim 16 wherein said pivot means include a cylindrical surface on said second locking projection, said first slot including a rounded contour at one end thereof for engaging said cylindrical surface.

21. A method for assembling a bed frame or the like including a mattress support and a support frame adapted to support at least a portion of said mattress support, said mattress support including a first bracket, said support frame including a second bracket for interconnection with said first bracket, one of said brackets having a locking means for engaging the other bracket while the other bracket has means for receiving and holding said locking means, said method comprising:

1. pivotally supporting one of said brackets on the other of said brackets while said support frame is generally folded with respect to said mattress support;
2. pivoting said support frame including said second bracket to an upright position with respect to said mattress support and said first bracket while camming said locking projection into said receiving means whereby said support frame is rigidly connected to said mattress support and said first bracket.

22. The method of claim 21 including pivotally supporting said first bracket on said second bracket while said support frame is lying on a support surface; said pivoting including lifting an end of said support frame to rotate the same about the point at which the other end of said support frame contacts said support surface.

23. The method of claim 21 wherein said camming includes sliding a projection on one of said brackets along an inclined surface on the other of said brackets while pivoting said other bracket including said inclined surface about a pivot pin extending between said brackets until said projection drops into a slot on said other bracket.

* * * * *